US005423459A

United States Patent [19]

Cater

[11] Patent Number: 5,423,459

[45] Date of Patent: Jun. 13, 1995

[54] CONTINUOUS SPRAY PUMP DISPENSER

[75] Inventor: Miro S. Cater, Newtown, Conn.

[73] Assignee: Newburgh Mfg Corporation, Newburgh, N.Y.

[21] Appl. No.: 279,561

[22] Filed: Jul. 25, 1994

[51] Int. Cl.[6] ..... B65D 88/54

[52] U.S. Cl. ..... 222/321.8; 222/341; 239/333

[58] Field of Search ..... 222/321, 341, 253, 255, 222/376, 381; 417/541, 544, 566, 555.1; 239/333

[56] References Cited

U.S. PATENT DOCUMENTS

| | | | |
|---|---|---|---|
| 3,967,762 | 7/1976 | Machon | 222/321 |
| 4,079,865 | 3/1978 | Kutik | 222/321 X |
| 4,191,313 | 3/1980 | Blake et al. | 222/341 X |
| 4,241,853 | 12/1980 | Pauls et al. | 417/544 X |
| 4,325,501 | 4/1982 | Shay | 222/321 |
| 4,503,996 | 3/1985 | Sorm et al. | 417/541 X |
| 4,646,969 | 3/1987 | Sorm et al. | 239/333 X |
| 5,092,495 | 3/1992 | Andre | 222/341 |

*Primary Examiner*—Gregory L. Huson

[57] ABSTRACT

A vertical hollow cylinder has a recess adjacent an upper end and a lower end constituting a throat. A vertical hollow outer piston is slidable in the cylinder with upper section extending above the cylinder and a lower section disposed within the cylinder. The lower section has first and second vertically spaced horizontal extensions disposed in slidable sealing engagement with the cylinder wall and has a third extension in slidable sealing engagement with the throat. The outer piston also has first and second vertically spaced channels extending from the second inner wall into the interior of the cylinder which are disposed respectively above the first extension and below the second extension. A lower variable volume is defined by a portion of the cylinder wall subtended between the second and third extensions and communicates with the second channel. A member is disposed within the recess, in sealing engagement with the upper section of the outer piston and cylinder wall. An upper variable volume is defined by another portion of the cylinder wall subtended between the member and the first extension and communicates with the first channel. A hollow vertical actuator is slidable in the outer piston and defines a discharge channel. A vertical hollow inner piston engages the interior of the actuator and has between its ends upper and lower vertically spaced skirts in slidable sealing engagement with the wall of the outer piston. The inner piston has a third channel which extends to the discharge orifice. second channel communicates only with the third channel.

10 Claims, 4 Drawing Sheets

CONTINUOUS SPRAY PUMP DISPENSER

BACKGROUND OF THE INVENTION

Most known pump dispensers used in dispensing personal and household care products discharge contents from their pump chambers the down stroke after the user has depressed an actuator. Discharge does not occur and the pump chambers are refilled during the subsequent return stroke.

in certain applications, however, it is desirable for the pump dispenser to spray continuously during both down strokes and return strokes as long as it is repeatedly actuated by the user.

Two types of continuous spray dispensers are known in the art. The first type is disclosed in U.S. Pat. Nos. 4,503,996 and 4,646,969. In this type of dispenser, a piston divides a pump chamber into a relatively large lower chamber and a smaller upper chamber. The piston is constructed to exhibit a predetermined leak during its down stroke so that while the lower chamber is emptied of fluid during discharge, a portion of the fluid in the lower chamber is deliberately leaked into the smaller upper chamber. During the return stroke, the upper chamber is emptied of fluid during discharge and the lower chamber is refilled with fluid. The discharges from this type of dispenser are unbalanced, since the volume dispensed during the return stroke must be smaller than that dispensed on the down stroke. Moreover, this type of dispenser utilizes a ball type check valve which relies at least partially on gravity for its operation, so that the dispenser can only be operated properly in upright position.

The second type of dispenser is disclosed in U.S. Pat. No. 5,092,495. In this second type of dispenser, a piston divides a pump chamber into a relatively large lower chamber and a smaller upper chamber in the same manner as described above. The leaky type of piston shown in the first type of dispenser is replaced in the second type of dispenser by a free running piston which during the downstroke allows free passage of liquid from the lower chamber into the upper chamber. The discharges from this second type of dispenser are also unbalanced, since the volume dispensed during the return stroke is smaller than that dispensed on the down stroke. Moreover, this second type of dispenser also utilizes the ball type check valve and the dispenser can only be operated properly in upright position.

The present invention is directed toward a new type of continuous spray pump dispenser which not only overcomes the disadvantages of the prior art dispensers described above but also has additional advantages which will be explained below.

SUMMARY OF THE INVENTION

Accordingly, it is an object of the present invention to provide a new and improved continuous spray pump dispenser wherein the volumes of discharge during down and return strokes are equal.

Another object is to provide a new and improved continuous spray pump dispenser which can be operated properly in upright, inverted or in between positions.

Yet another object is to provide a new and improved continuous spray pump dispenser of the character indicated which eliminates use of ball type check valves, leaky pistons and free running pistons.

Still another object is to provide a new and improved continuous spray pump dispenser of the character indicated which employs a unique structure for returning air into a fluid container to which the dispenser is secured while preventing leakage of fluid during production of spray.

These and other objects and advantages of this invention will either be explained or will become apparent hereinafter.

The invention is directed toward a pump dispenser which when connected to a container of fluid and actuated will spray liquid during both down and return strokes.

The dispenser employs a vertical hollow cylinder having upper and lower open ends and a first inner wall. The first inner wall has a recess adjacent the upper end. The diameter of the upper end is larger than that of the lower end, the lower end constituting a throat.

A vertical hollow outer piston has a second inner wall and is slidable in the cylinder. This piston has an upper section extending above the cylinder and has a lower section disposed within the cylinder. The lower section has first and second vertically spaced horizontal extensions disposed in slidable sealing engagement with the first inner wall and has third extension disposed below the first and second extensions which is in slidable sealing engagement with the throat. The outer piston also has first and second vertically spaced channels extending from the second inner wall into the interior of the cylinder which are disposed respectively above the first extension and below the second extension;

A lower variable volume is defined by a portion of the first inner wall subtended between the second and third extensions. The lower volume communicates with the second channel.

A member is disposed within the recess, the member being in sealing engagement with the upper section of the outer piston and with the first inner wall.

An upper variable volume is defined by another portion of the first inner wall subtended between the member and the first extension, the first channel communicating with the upper volume.

A hollow vertical actuator slidable in the outer piston has an upper open end for fluid discharge and a lower open end.

A vertical hollow inner piston has an upper open end and a lower closed end. The inner piston engages the interior of the actuator and extend, therebelow. The inner piston between its ends has upper and lower vertically spaced skirts in slidable sealing engagement with the second inner wall. The inner piston has a third channel which extends from its hollow interior through a region subtended between the first inner wall, the outer piston and the upper and lower skirts, and then extends upward through the inner piston and actuator to the discharge orifice. The inner piston has a first position at which the skirts are disposed on opposite sides of the first channel and the first channel communicates only with the third channel and having a second position at which the skirts are disposed on opposite sides of the second channel and the second channel communicates only with the third channel.

A liquid feed channel is provided for transporting liquid from the container into the dispenser, the feed channel communicating with the second channel when the third channel communicates with the first channel, the additional channel communicating with the first channel when the third channel communicates with the second channel.

Each of the upper and lower variable volumes has a first state at which it attains a minimum value and a second state at which it attains a maximum value. Either one of the upper and lower volumes is in one of these two states while the other one is in the other of the two states. The sum of the upper and lower variable volumes always has the same constant value.

At rest position, the actuator must be depressed to initiate a downstroke. At the completion of the downstroke, the return stroke is automatically initiated as the completion of which the actuator returned to rest position.

When the actuator is in rest position, the upper volume is in the second state and contains no fluid. The upper volume is connected via the first channel to the third channel and the lower volume is connected via the second channel to the liquid feed channel. The lower volume is in the first state and is filled with fluid.

The actuator is then depressed to initiate the down stroke. As the actuator moves downward, the lower volume is connected via the second channel to the third channel and the upper volume is connected via the first channel to the feed channel. The upper volume is continuously enlarged and filled with fluid, attaining its first state at the completion of the down stroke. At the same time, the lower volume is continuously reduced and its fluid is discharged via the second and third channels.

The return stroke is automatically initiated upon termination of the down stroke. The process is reversed with the lower volume expanding and being filled with fluid, and the upper volume being continuously reduced with its fluid being discharged via the first and third channels.

The minimum and maximum volume values for the lower variable volume are adjusted to be equal to the corresponding values of the upper variable volume so that the volume of discharge during the down stroke will be equal to the volume of discharge during the return stroke.

The dispenser does not use a a ball type check valve or other check valve and can be operated when held in any position.

DETAILED DESCRIPTION OF THE PREFERRED EMBODIMENTS

Figure 1:
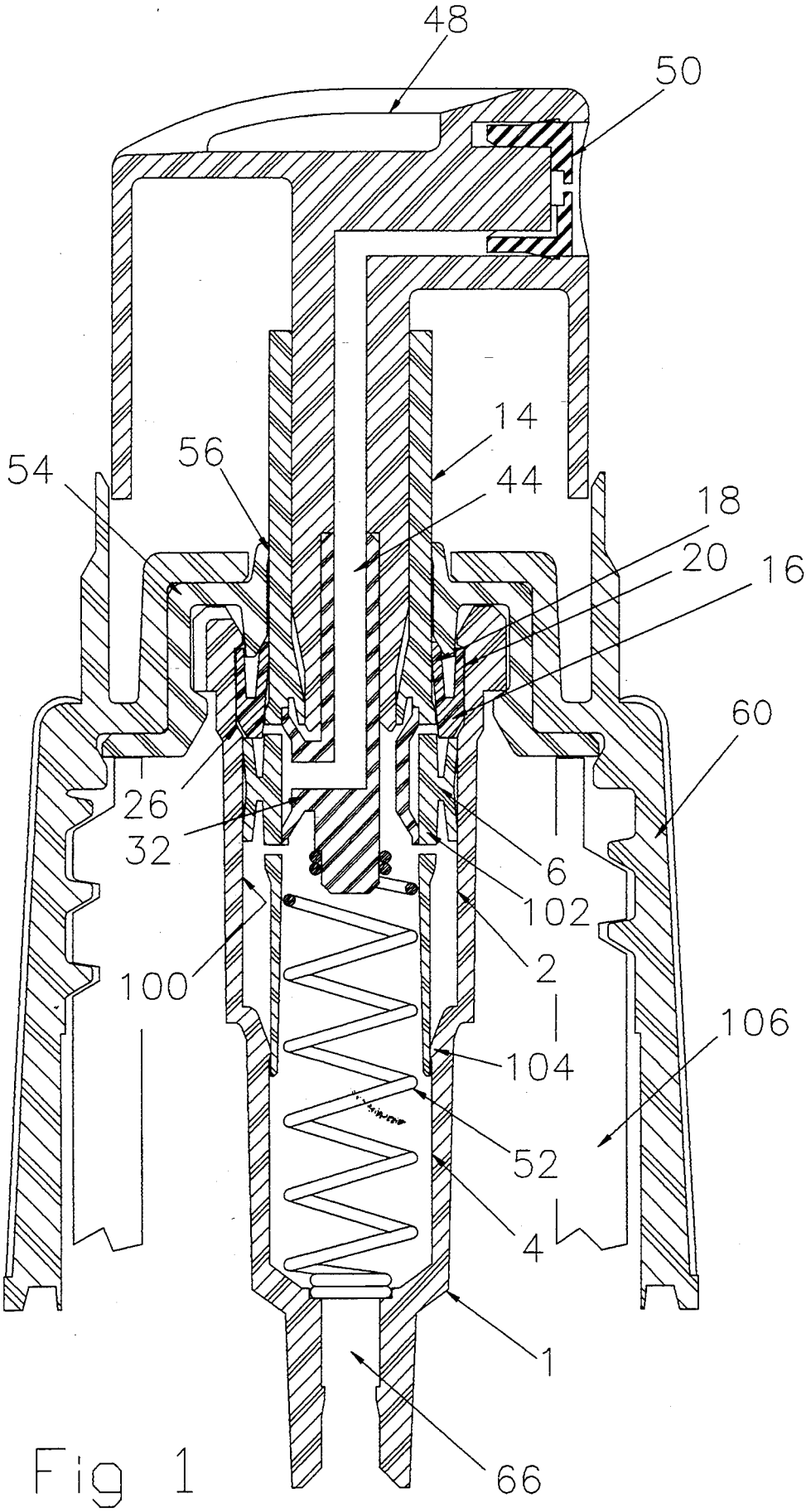
FIG. 1 is a vertical cross sectional view of a preferred embodiment of a dispenser as shown in rest position.

Referring now to FIGS. 1, 1 A, 2, 3 and 4, a vertical hollow cylinder 2 has upper and lower open ends and a first inner wall 100. Inner wall 100 has a recess 26 adjacent the upper end. The diameter of the upper end of cylinder 2 is larger than that of the lower end, the lower end constituting a throat 104. Throat 104 has an integral cylindrical extension 4 which can be adjusted in length as desired. Extension 4 can have a reduced shoulder 1 so that an additional extension of reduced diameter can support a dip tube, if such tube is needed.

A vertical hollow outer piston 6 has a second inner wall 102 and is slidable in cylinder 2. Piston 6 has an upper cylindrical section 14 extending above the cylinder and has a lower section disposed within the cylinder. The lower section has first and second vertically spaced horizontal extensions 8 and 10 disposed in slidable sealing engagement with the first inner wall. The lower section has a third extension 12 disposed below the first and second extensions and in slidable sealing engagement with the throat 104.

A portion of the first inner wall 100 subtended between the second and third extensions 10 and 12 defines therewith a lower variable volume 22. The lower volume has a first state at which it attains a maximum value and has a second state at which it attains a minimum value.

Piston 6 has first and second vertically spaced channels 28 and 30 extending from the second inner wall into the interior of the cylinder and disposed respectively above the first extension 8 and below the second extension 10, the second channel 30 communicating with the lower volume 22.

A member 16 forms a seal which is disposed within recess 26. Member 16 closes off the upper end of the cylinder 2 by forming sliding seals with cylinder 2 and extension 14. For this purpose, member 16 has an inner resilient skirt 18 and an outer resilient skirt 20 and is capable of small axial motion within recess 26.

An upper variable volume 24 is formed by the portion of inner wall 100 subtended between extension 8 and skirts 18 and 20. The upper volume has a first state at which it attains a maximum value and has a second state at which it attains a minimum value. The sum of the upper and lower volumes has always the same constant value. The first channel 28 communicates with the upper volume.

A hollow vertical actuator 48 has an upper open end for fluid discharge via third channel 44 and a lower open end. An optional insert 50 is disposed in the actuator. The actuator is slidable in piston 6.

A vertical hollow inner piston 32 has an upper open end and a lower closed end. Piston 32 is disposed within and is secured to the interior of the actuator and extends therebelow. Piston 32 between its ends has an upper skirt 34 and a vertically spaced lower skirt 36 in slidable sealing engagement with the second inner wall 103 of piston 6. Third channel 44 extends through a region 42 subtended between the first inner wall, the outer piston and the upper and lower skirts, and then extends upward through the inner piston interior and the actuator interior to the discharge orifice. Piston 32 has a first position at which the skirts 34 and 36 are disposed on opposite sides of the first channel 28 and the first channel 28 communicates only with the third channel 44 and has a second position at which the skirts 34 and 36 are disposed on opposite sides of the second channel 30 and the second channel 30 communicates only with the third channel 44.

Spring biasing means 52 has a lower end engaging the shoulder 1 and extends upwardly though cylindrical extension 4 to bias the piston 32 and actuator 48 into top raised position.

Figure 4:
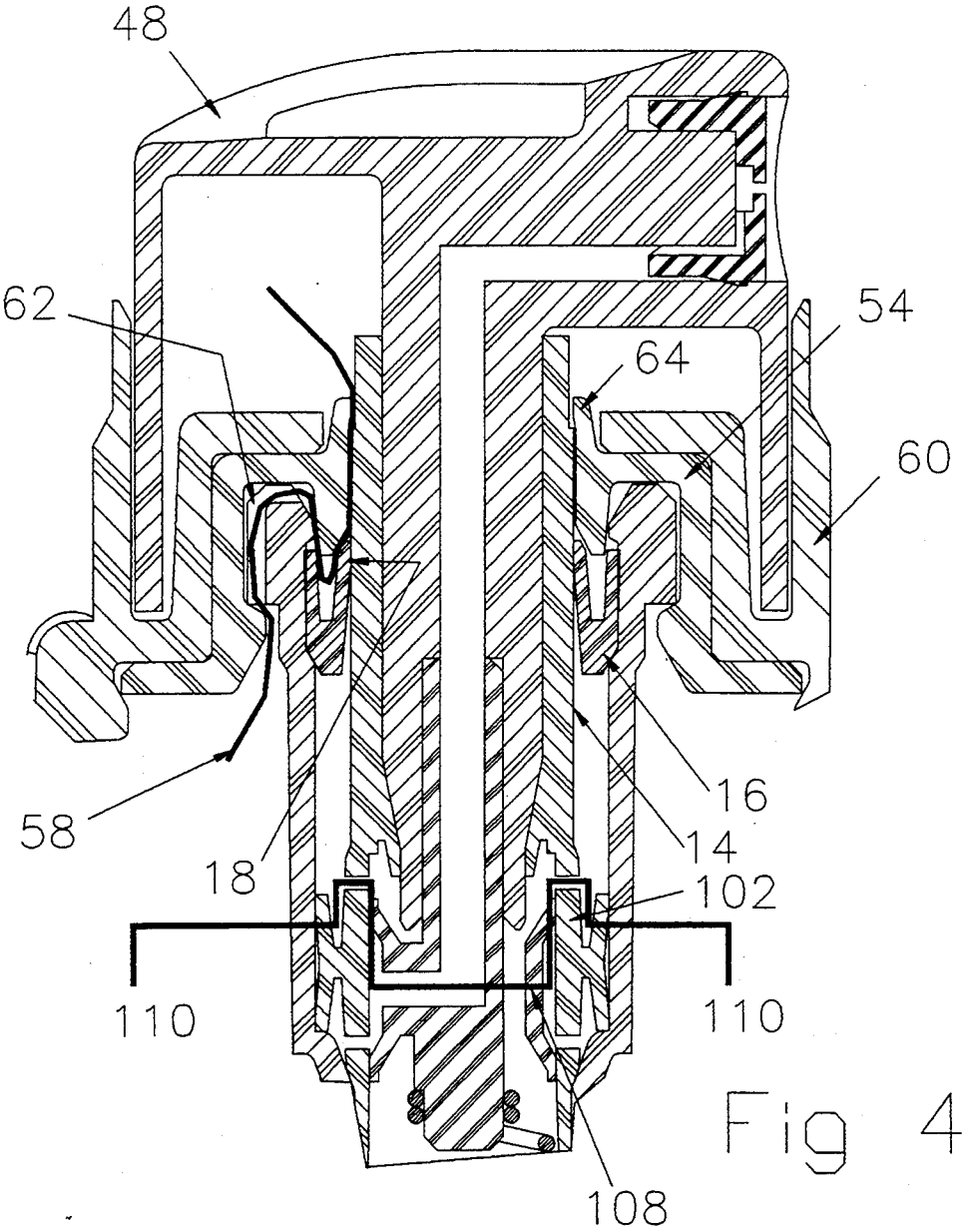
FIG. 4 is an enlarged detail view of a portion of the structure shown in FIG. 2.
Figure 1A:
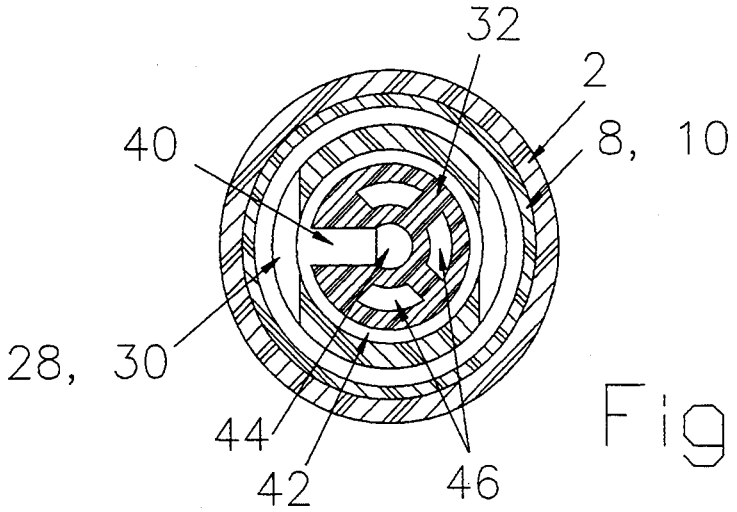
FIG. 1A is a horizontal cross sectional view of the structure in FIG. 1 as taken along line 110—110.
Figure 2:
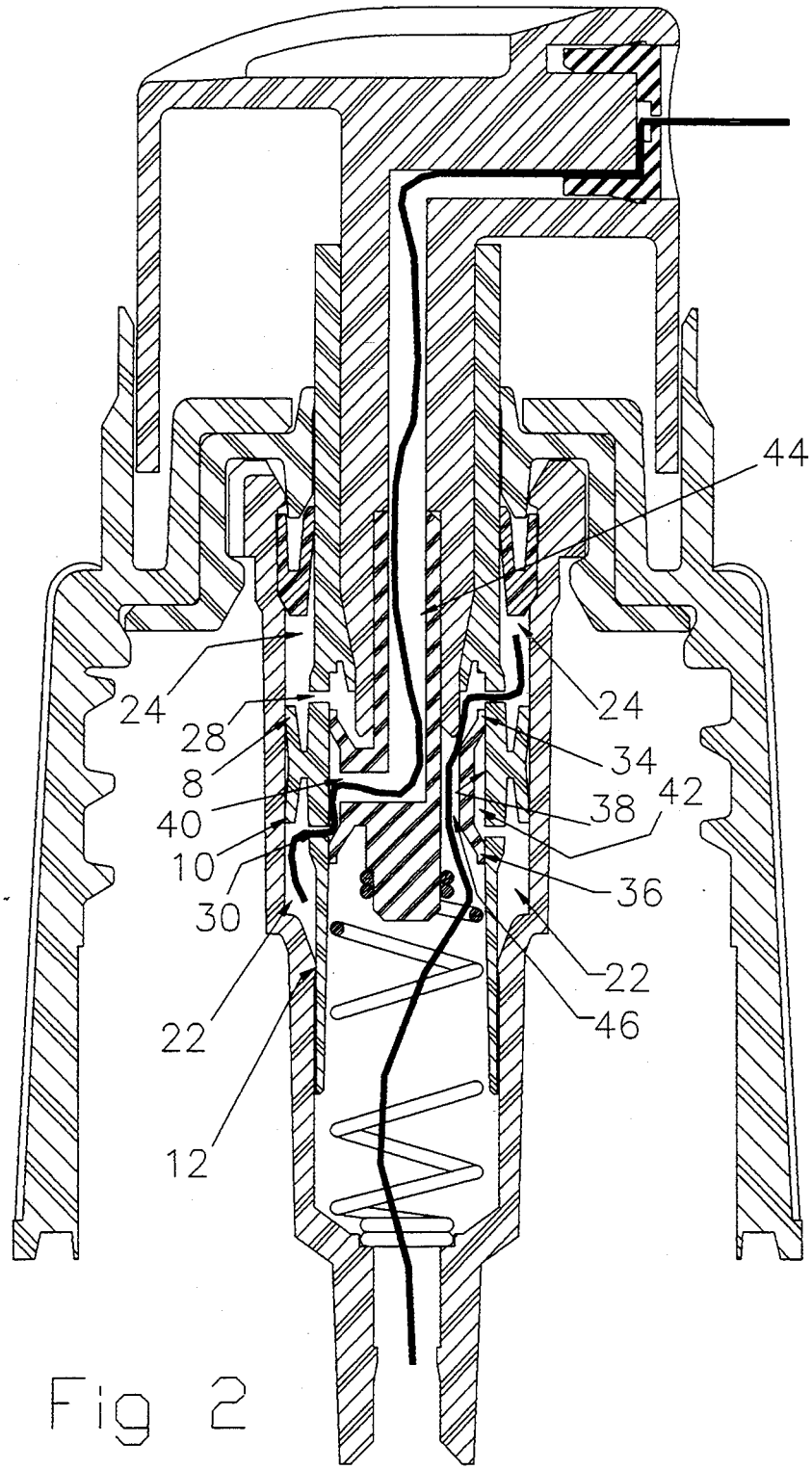
FIG. 2 is a view similar to FIG. 1 showing the dispenser during a down stroke [the first active stroke].
Figure 3:
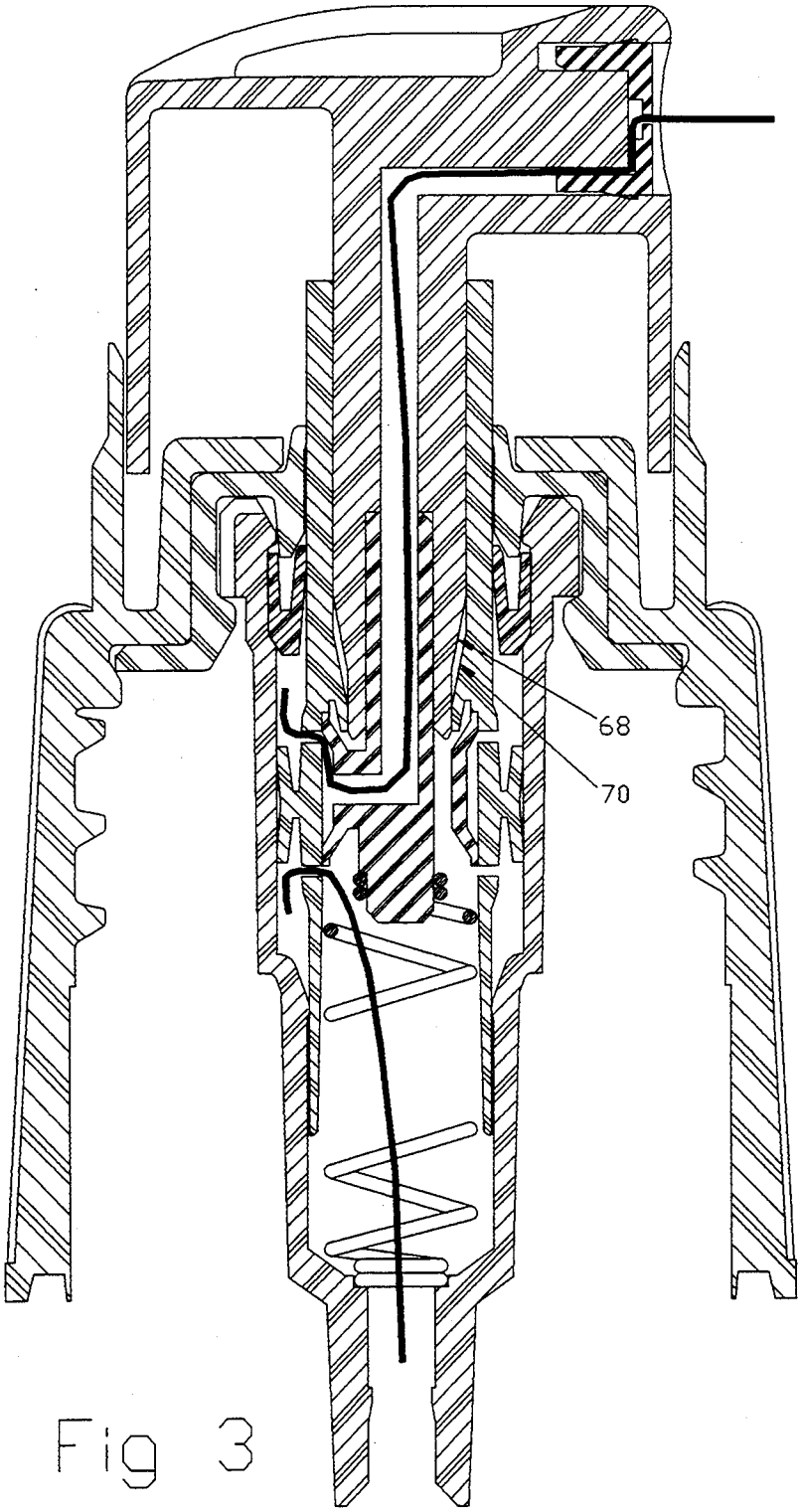
FIG. 3 is a view similar to FIG. 1 showing the dispenser during the following up stroke [the other active stroke].

A collar 54 encloses the upper end of cylinder 2 and the member 16. The collar forms a sliding seal with upper extension 14, except when the piston 6 reaches its extreme down position. When piston 6 reaches this position as shown in FIG. 4, a path 58 is established between extension 14, lip 64 of the collar, member 16 and a slot 62 in cylinder 2. Path 58 is a return air path to replenish the column of liquid pumped out of the container 106. In order for path 58 to be established, member 16 must be moved slightly in the axial direction in the recess 26 so that the air can flow over and between the skirts 18 and 20.

A plastic threaded cap 60 secures the structure to the container.

Piston 32 has a fourth channel 38 which communicates with the throat via a fifth channel 66, thus forming a fluid flow path from the container. Piston 32 also has a skirt 108 having an upper lip 34 and vertically spaced lower lip 36.

When the dispenser is in rest position, biasing means 52 forces the piston 32 and actuator 48 upwards. Lip 34 of piston 32 engages piston 6 and forces it upwards against member 16 so that skirt 18 is forced against the collar 54. Lips 34 and 36 are so positioned that the upper volume 24 is in its second [minimum] state and is connected via channel 30 to channel 44, having just been fully discharged of its liquid contents. At the same time, the lower volume 22 is in its first [maximum] state and is connected via channel 28 to the inlet channel 66, having just been filled with its liquid contents.

At the initiation of the down stroke, the piston 32 and actuator 48 first move downward without movement of piston 6 until conical surface of 68 engage mating surface 70 of piston 6. On continuation of the downstroke, the two pistons and actuator move downward as a unit. When pistons 32 and 6 and the actuator 48 move in this fashion, lips 34 and 36 connect volume 22 via channel 28 to channel 44 and connect volume 24 via channel 30 to inlet channel 66. Liquid is discharged via volume 22 as its volume decreases and liquid fills volume 24 as its volume increases. Upon completion of the downstroke, volume 22 is in its second [minimum] state and is emptied of fluid, while volume 24 in its first [maximum] state and is filled with fluid.

On the return stroke, the biasing means 52 first forces the piston 32 and actuator 48 upward while piston 6 remains in its lowest position. This action causes lips 34 and 36 to connect volume 22 via channel 28 to inlet channel 66 and to connect volume 24 via channel 30 to channel 44. Further upward movement of piston 32 then causes lip 34 to engage piston 6 and move it upwards. This action forces volume 24 to discharge fluid and decrease in volume while causing volume 22 to fill with fluid and increase in volume. Piston 6 is moved upwards to its initial position. Piston 32 and actuator 48 continue to move upwards to the rest position.

As a result, fluid discharge is produced during down and return strokes. The volumes 22 and 24 can be balanced, producing an even discharge during each stroke.

If the container has its own vent system and it is not necessary to vent the dispenser, member 16 can be held in fixed position in recess 26.

While the invention has been described with particular reference to the drawings and preferred embodiment, the protection sought is to be limited only by the terms of the claims which follow.

What is claimed is:

1. A pump dispenser which when connected to a container of fluid and actuated will spray liquid during both down and return strokes, said dispenser comprising:

a vertical hollow cylinder having upper and lower open ends and a first inner wall, the first inner wall having a recess adjacent the upper end, the diameter of the upper end being larger than that of the lower end, the lower end constituting a throat;

a vertical hollow outer piston having a second inner wall and slidable in the cylinder, the piston having an upper section extending above the cylinder and having a lower section disposed within the cylinder, the lower section having first and second vertically spaced horizontal extensions disposed in slidable sealing engagement with the first inner wall, the lower section having a third extension disposed below the first and second extensions and in slidable sealing engagement with the throat, the outer piston having first and second vertically spaced channels extending from the second inner wall into the interior of the cylinder and disposed respectively above the first extension and below the second extension;

a lower variable volume defined by a portion of the first inner wall subtended between the second and third extensions, the lower volume communicating with the second channel;

a member disposed within the recess, the member being in sealing engagement with the upper section of the outer piston and with the first inner wall;

an upper variable volume defined by another portion of the first inner wall subtended between the member and the first extension, the first channel communicating with the upper volume;

a hollow vertical actuator having an upper open end for fluid discharge and a lower open end, the actuator being slidable in said outer piston; and a vertical hollow inner piston having an upper open end and a lower closed end, the inner piston engaging the interior of the actuator and extending therebelow, the inner piston between its ends having upper and lower vertically spaced skirts in slidable sealing engagement with the second inner wall, the inner piston having a third channel which extends from its hollow interior through a region subtended between the first inner wall, the outer piston and the upper and lower skirts, and then extends upward through the inner piston and actuator to the discharge orifice, the inner piston having a first position at which the skirts are disposed on opposite sides of the first channel and the first channel communicates only with the third channel and having a second position at which the skirts are disposed on opposite sides of the second channel and the second channel communicates only with the third channel.

2. The dispenser of claim 1 further including a liquid feed channel for transporting liquid from the container into the dispenser, the feed channel communicating with the second channel when the third channel communicates with the first channel, the additional channel communicating with the first channel when the third channel communicates with the second channel.

3. The dispenser of claim 2 wherein said member is axially movable in the recess and has two spaced upwardly extending resilient skirts.

4. The dispenser of claim 2 wherein said member is fixed in position in the recess.

5. The dispenser of claim 2 wherein each of the two volumes has a first state in which it has a maximum value and a second state in which it has a minimum value, either one of the first and second volumes being in one of the two states when the other volume is in the other of the two states, the sum of the two volumes being always the same constant.

6. The dispenser of claim 2 wherein the inner piston is raised when in the first position and is lowered when in the second position.

7. The dispenser of claim 6 further including biasing means to bias the actuator and inner piston into the first position.

8. The dispenser of claim 7 wherein the actuator has a fully raised position at the inception of a down stroke and a fully lowered position at the inception of a return stroke, the actuator and outer piston having mutually engagable and disengageable mating surfaces which are engaged causing the actuator and outer piston to move downward together during the down stroke after the actuator is positioned at a selected position intermediate fully raised and fully lowered positions and causing the actuator and outer piston to move upward together during the return stroke until the actuator returns to its selected position, the surfaces being otherwise disengaged, the actuator and outer piston being free to move independently of one another when said surfaces are disengaged.

9. The dispenser of claim 8 wherein during an initial period following the inception of a down stroke the actuator moves downward relative to the outer piston and therafter until the completion of the down stroke the actuator and outer piston are engaged and move downward together, the actuator and outer piston remaining engaged during an initial period following the inception of the subsequent return stroke and move upward together and thereafter until the completion of the return stroke, the outer piston and actuator are disengaged, the outer piston exhibiting no further movement while the actuator continues to move upward.

10. The dispenser of claim 9 wherein the biasing means is a spring disposed in the cylinder and bearing against the lower end of the inner piston.

* * * * *